US005630511A

United States Patent [19]

Bose

[11] Patent Number: 5,630,511

[45] Date of Patent: May 20, 1997

[54] DISPENSING BOX AND METHOD FOR THE CONTINUOUS FEED OF FAN-FOLDED COMPUTER PAPER

[75] Inventor: Ajit K. Bose, Lawrenceville, N.J.

[73] Assignee: Union Camp Corporation, Lawrenceville, N.J.

[21] Appl. No.: 533,702

[22] Filed: Sep. 26, 1995

[51] Int. Cl.[6] ..... B65H 5/28

[52] U.S. Cl. ..... 206/555; 206/215; 206/409; 221/287; 221/303; 400/613.2

[58] Field of Search ..... 206/555, 215, 206/390, 409; 226/197, 182; 221/197, 287, 903; 271/145, 113; 400/613.2, 613.3

[56] References Cited

U.S. PATENT DOCUMENTS

| | | | |
|---|---|---|---|
| 3,411,698 | 11/1968 | Reynolds | 206/390 |
| 3,826,361 | 7/1974 | Heckrodt | 206/409 |
| 4,054,235 | 10/1977 | Witcher | 400/613.3 |
| 4,113,141 | 9/1978 | Kronfeld | 206/409 |
| 4,252,453 | 2/1981 | Estabrooks | 400/613.2 |
| 4,773,532 | 9/1988 | Stephenson | 206/390 |
| 5,080,236 | 1/1992 | Conner | 400/613.2 |
| 5,092,573 | 3/1992 | Abreu | 226/197 |
| 5,467,179 | 11/1995 | Boeck et al. | 226/197 |

*Primary Examiner*—Paul T. Sewell
*Assistant Examiner*—Luan K. Bui
*Attorney, Agent, or Firm*—Dennis H. Lambert & Assoc.

[57] ABSTRACT

A dispensing box for the continuous feed of fan-folded paper to a printer or other device. The box has opposite side walls, a bottom and an open top, and a lid covering the open top. A narrow slot is formed through the lid, extending from one side to the other adjacent one end of the box, and a free end of the fan-folded paper is fed through the slot from inside the box to a printer or other device. A roller is positioned inside the box adjacent the slot for guiding movement of the paper and smoothing its movement as it is pulled from the box by the printer or other device.

10 Claims, 3 Drawing Sheets

DISPENSING BOX AND METHOD FOR THE CONTINUOUS FEED OF FAN-FOLDED COMPUTER PAPER

FIELD OF THE INVENTION:

This invention relates to packages for holding and feeding fan-folded computer paper from a carton to a printer. More particularly, the invention relates to such a package in which means is provided to facilitate feed of the paper from the carton and which enables the lid to be left in place to prevent dirt and debris and the like from entering the carton during use.

BACKGROUND OF THE INVENTION:

Fan-folded paper for continuous feed to a printer is typically packaged in a carton having a removable lid. In use, the lid is removed and the free end of the paper is fed to a device (e.g., a printer) for pulling the paper from the carton and through the printer. Such packages are left open during use and are susceptible to dirt, dust and other debris which can enter the open top of the carton. U.S. Pat. No. 5,099,996 discloses a carton for feeding fan-folded paper, wherein a tray is positioned over the open top of the carton during use for catching the paper as it leaves the printer. Applicant is not aware of any other package for feeding fan-folded paper wherein a lid or cover is left on the carton during use to prevent entry of dirt, debris and the like into the carton.

Accordingly, there is need for a box or carton for the continuous feed of fan-folded paper to a printer or other device, in which means is provided for preventing entry of dirt, dust and the like into the carton during use.

SUMMARY OF THE INVENTION:

The present invention provides a package for holding and feeding fan-folded paper to a printer or other device, in which the package includes a carton with means to keep dirt, dust and debris and the like from falling into the carton during use.

To accomplish this, an essentially conventional carton for holding fan-folded paper is modified by perforating the lid near one end to provide a frangible section that can be removed to form a narrow slot extending across the width of one end of the lid. A roller is supported in the carton beneath the lid adjacent the slot for guiding the paper as it is fed from the carton.

When the package of the invention is ready for use, the lid is removed and the perforated section punched out to form the slot, and the roller is positioned near the free end of the fan-folded paper in the carton. This free end is then inserted upwardly through the slot and the lid is placed back on the carton so that the carton of paper is essentially completely covered as illustrated in FIG. 2. The roller guides the paper as it is pulled through the slot and provides for much smoother operation than would be accomplished without the roller.

The roller itself can comprise a paper tube such as that on which sheet material is typically wrapped, or it may be manufactured specifically for the purpose, using ink sludge or other post-consumer secondary fibers. The roller is supported by any suitable support extended through it and engaged with the side walls of the carton, including a wire rod or molded plastic member or the like. Further, the roller support may have hooked ends as indicated in FIG. 8, or it may be pinned through the side walls of the carton in a predetermined location. An advantage of the hooked ends shown in FIG. 8 is that the consumer may position or reposition the roller as desired.

BRIEF DESCRIPTION OF THE DRAWINGS:

The foregoing, as well as other objects and advantages of the invention, will become apparent from the following detailed description when considered in conjunction with the accompanying drawings, wherein like reference characters designate like parts throughout the several views, and wherein:

FIG. 1 is a top perspective view of a fan-folded paper feed carton according to the prior art, showing how the top of the carton is left open when the lid is removed, exposing the carton to dirt, debris and the like.

Figure 2:
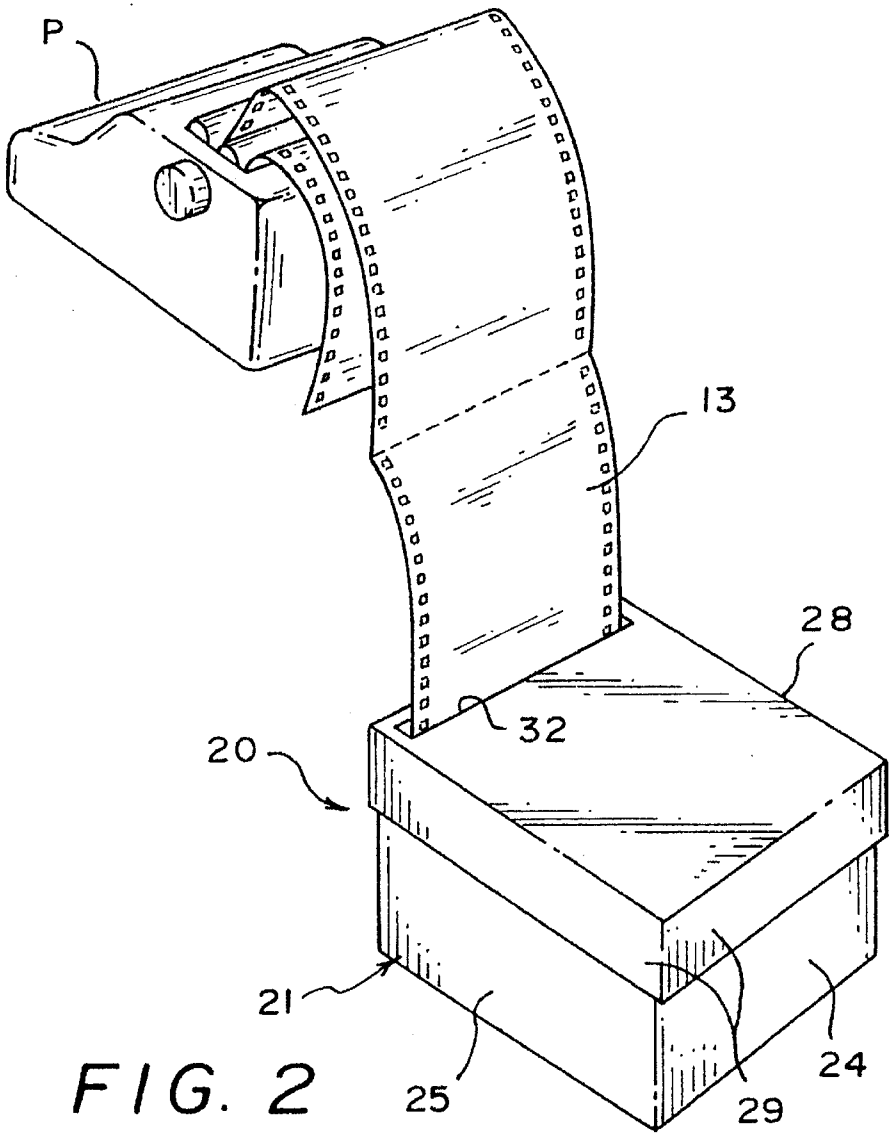
FIG. 2 is a top perspective view of a carton incorporating the features of the invention, and showing how the top of the carton is closed to prevent entry of dirt, debris and the like into the carton during use.
Figure 1:
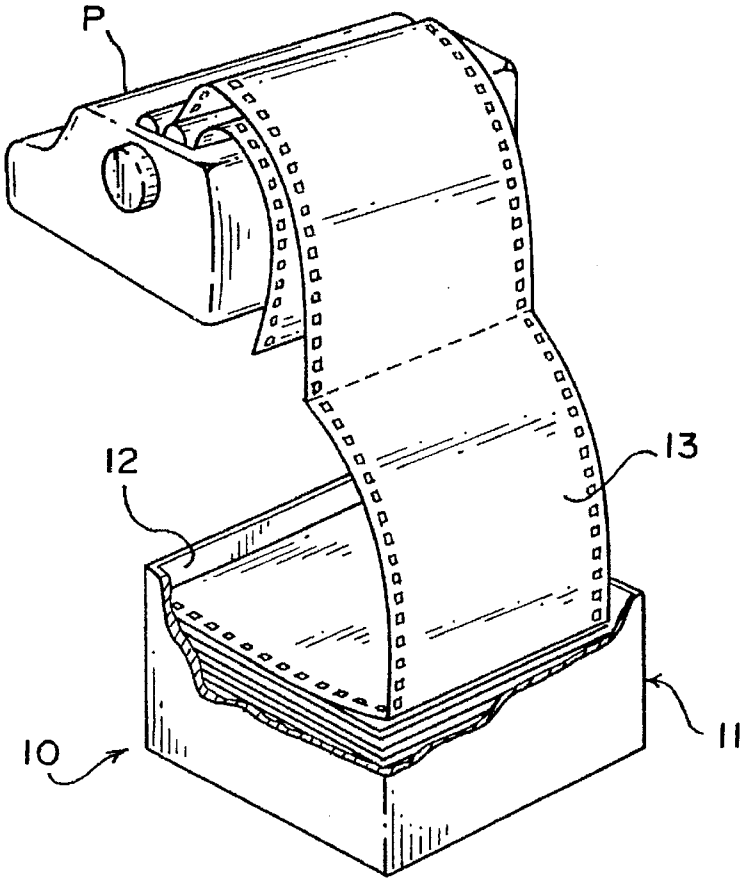
FIG. 1 (PRIOR ART)
Figure 4:
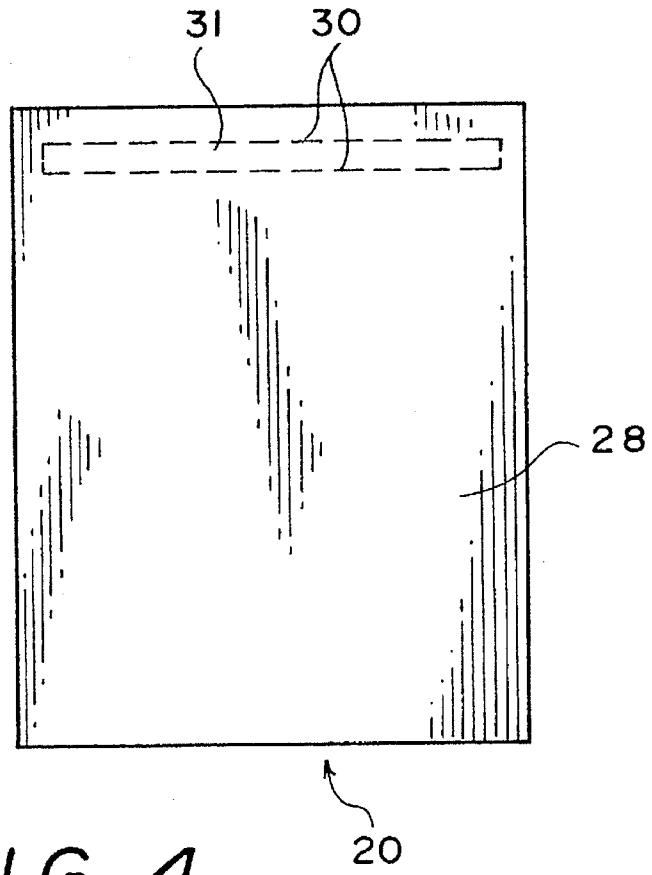
FIG. 4 is a top plan view of the lid of the carton of the invention, prior to removal of the frangible section to form the slot.
Figure 3:
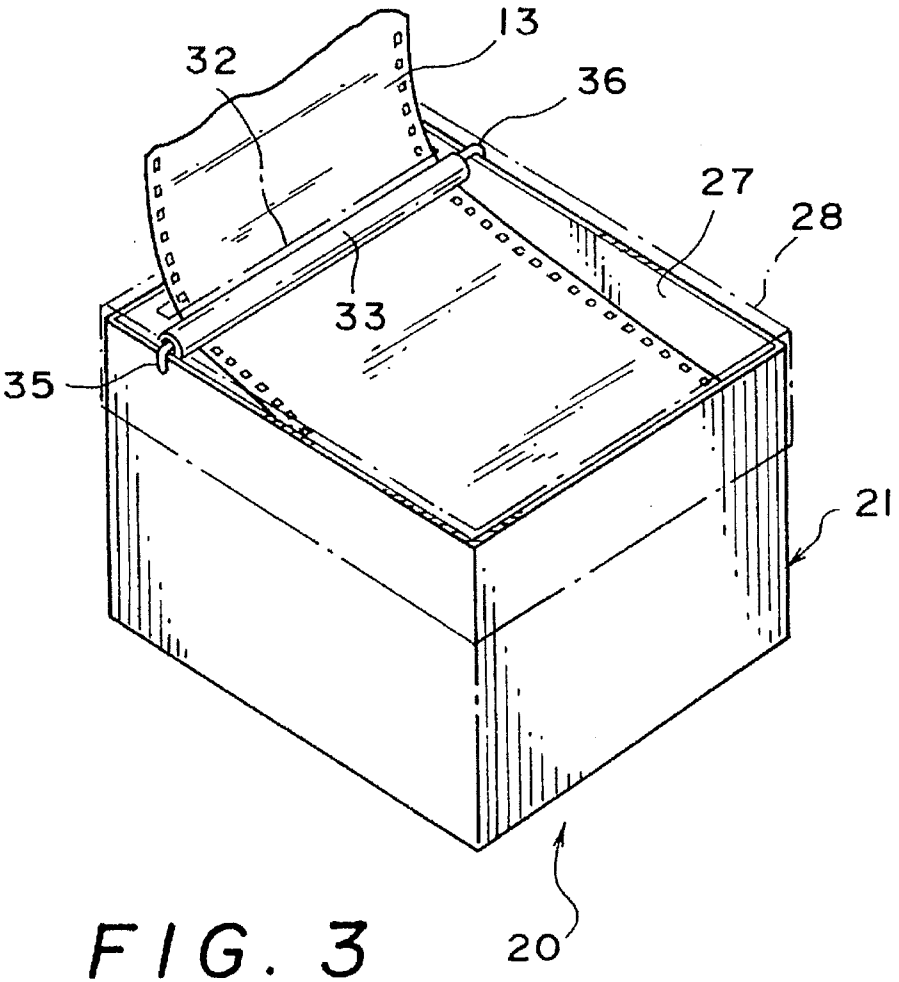
FIG. 3 is a top perspective view of a carton incorporating the features of the invention, with the lid shown in dot-and-dash lines for clarity in illustrating the positioning and use of the roller.
Figure 5:
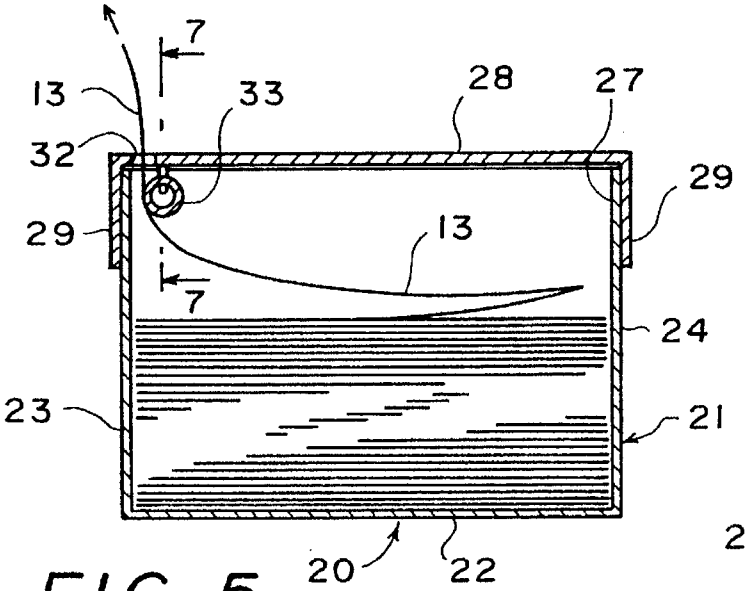
FIG. 5 is a longitudinal, sectional view of the carton of FIG. 2.
Figure 7:
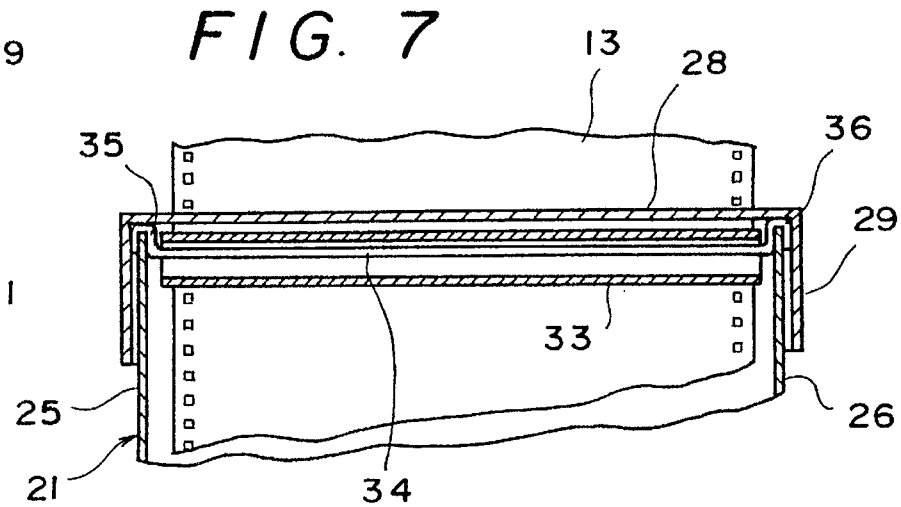
FIG. 7 is an enlarged fragmentary transverse sectional view taken along line 7—7 in FIG. 5.
Figure 8:
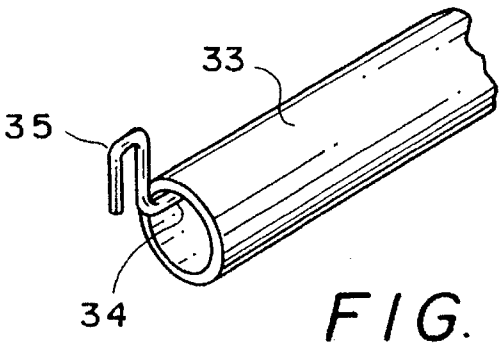
FIG. 8 is an enlarged fragmentary perspective view showing one end of the roller and its support.
Figure 6:
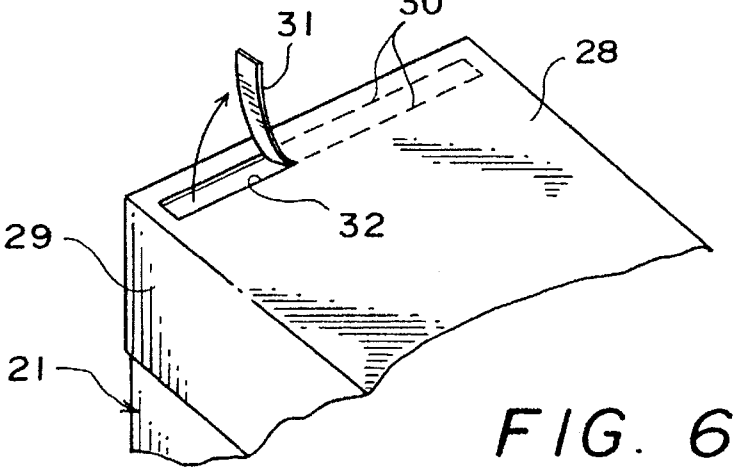
FIG. 6 is a fragmentary perspective view of the carton of FIG. 2, showing the frangible section being removed to form the slot.

DETAILED DESCRIPTION OF THE PREFERRED EMBODIMENTS:

Referring more particularly to the drawings, a typical carton used for holding and feeding fan-folded paper to a printer or the like as used in the prior art is indicated generally at 10 in FIG. 1. As indicated in this figure, the box or carton 11 has an open top 12 that is exposed to the ambient environment after the lid is removed. Accordingly, as the paper 13 is fed to a printer P or other device, the open top of the carton is susceptible to entry of dirt, dust, staples, paper clips and other debris into the carton, contaminating the paper.

An improved carton for the continuous feed of fan-folded paper 13 to a printer P or the like is indicated generally at 20 in FIGS. 2–5. The improved carton includes an essentially conventional box or carton 21 having a bottom 22, opposite end walls 23 and 24, and opposite side walls 25 and 26. The open top 27 of the carton is closed by a lid 28 which has depending flanges or walls 29 that extend in encircling relationship over the upper ends of the side and end walls of the carton when the lid is resting on the open top thereof.

The lid 28 has spaced parallel lines of perforations 30 near one end, defining a removable strip 31 that may be torn or punched from the lid to form an elongate narrow slot 32 through the top wall of the lid adjacent one end thereof.

A roller 33 is supported in said one end of the carton beneath the slot 32 and adjacent the top of the carton immediately beneath the lid 28. The roller is supported by an elongate support rod 34 having hooked ends 35 and 36 which engage over the upper side edges of the carton. Alternatively, the support rod for the roller could be pinned directly to the side walls of the carton or punched through it, etc., or supported in any other desirable way to maintain the roller in position immediately adjacent but spaced slightly below the lid at the location of the slot 32.

In use, the frangible strip or section 31 is removed along the perforated lines 30, forming the slot 32, and the free end of the paper 13 is fed beneath the roller 33 and through the slot 32. See FIG. 5. The lid 28 is then repositioned on the carton 21, covering its open upper end and preventing entry of dirt, dust, debris and the like into the carton.

In a preferred construction, the length of the roller 33 should match the width of the paper 13 and should be supported a distance beneath the lid 28 to insure free rotational movement of the roller as the paper 13 moves past it and through the slot 32 to the printer P. Typical cartons or boxes for holding fan-folded paper are approximately 9½×11 inches and are capable of holding approximately 2,700 sheets of paper. The modified carton of the invention may be made slightly taller and approximately ⅛ of an inch wider to contain the standard 2,700 sheets of paper, and accommodate the roller while allowing for easier paper movement. Of course, the carton can be made in other sizes, as desired.

The roller can be made of paper or any other suitable material, including ink sludge or other post-consumer secondary fibers. The roller support may comprise a wire rod with loops formed at the end, or it may be made of other material such as molded plastic or the like, as desired.

Prior to removal of the separable strip 31 to form the slot 32, the carton of the invention functions essentially identically to a conventional carton and maintains a closed environment for the paper 13 until it is ready for use.

While particular embodiments of the invention have been illustrated and described in detail herein, it should be understood that various changes and modifications may be made to the invention without departing from the spirit and intent of the invention as defined by the scope of the appended claims.

What is claimed is:

1. A carton for shipping, storing, holding and dispensing a quantity of fan-folded paper for supply to a printer; said carton comprising:

a bottom, opposite side and end walls having an upper edge, an open top, and a lid covering the open top;

said lid having length and width dimensions and means defining an elongate slot therein adjacent one end and extending across the width of the lid, whereby one end of the fan-folded paper can be extended through the slot for feeding the paper from the carton through the slot in the lid, with the lid in place on the carton, to thereby prevent ingress of dirt, debris and the like into the carton during use; and a guide roller supported on the upper edge of the side walls adjacent the slot, in a position to be engaged by the fan-folded paper as it is fed through the slot, to guide and smooth the flow of the paper through the slot.

2. A carton as claimed in claim 1, wherein:

the slot is formed by a tear-out panel that is removed when the carton is ready for use, whereby the carton remains closed and sealed prior to removal of the panel.

3. A carton as claimed in claim 1, wherein:

the roller comprises a tubular member extending side-to-side in the carton, said tubular member being rotatably supported on support means that is supported on the upper edge of the carton.

4. A carton as claimed in claim 3, wherein:

the support means comprises a rod extended longitudinally through the roller and supported at its opposite ends on the carton side walls.

5. A carton as claimed in claim 4, wherein:

the opposite ends of the rod are hook-shaped and are engaged over the upper edges of the open top of the carton.

6. A carton as claimed in claim 5, wherein:

the roller comprises a paper tube.

7. A carton as claimed in claim 1, wherein:

a quantity of fan-folded paper having a free end is supported in the carton, said free end being guided around the roller and fed through the slot.

8. A carton as claimed in claim 2, wherein:

the roller comprises a tubular member extending side-to-side in the carton, said tubular member being rotatably supported on support means that is supported on the carton.

9. A carton as claimed in claim 1, wherein:

the support means comprises a rod extended longitudinally through the roller and supported at its opposite ends on the carton side walls.

10. A method for storing, shipping and holding fan-folded paper for continuous feed of the fan-folded paper to a printer or other device from a carton holding a quantity of said fan-folded paper, wherein said carton has a bottom, opposite side walls with upper edges, an open top, and a lid covering said open top, comprising the steps of:

forming a narrow slot-like opening through said lid;

feeding a free end of the fan-folded paper through the slot from inside the carton to outside the carton; and guiding the paper through the slot over a roller supported on the upper edges of the carton side walls adjacent to slot-like opening to smooth the movement of the paper before it reaches the slot-like opening as the paper is pulled from the carton, said lid being left in place on the carton to prevent dirt, dust, and other debris from entering the carton during use.

* * * * *